United States Patent [19]

Farrell

[11] 4,333,036

[45] Jun. 1, 1982

[54] ANODE FOIL HOLDER FOR BROAD BEAM ELECTRON GUN

[75] Inventor: Sherman R. Farrell, Orinda, Calif.

[73] Assignee: RPC Industries, Hayward, Calif.

[21] Appl. No.: 144,244

[22] Filed: Apr. 28, 1980

[51] Int. Cl.[3] ..... H01J 33/04

[52] U.S. Cl. ..... 313/420; 328/233

[58] Field of Search ..... 328/233; 313/93, 278, 313/420

[56] References Cited

U.S. PATENT DOCUMENTS 3,863,163 1/1975 Farrell et al. ..... 328/233

4,061,944 12/1977 Gay ..... 313/420

FOREIGN PATENT DOCUMENTS 50-25599 8/1975 Japan ..... 313/420

*Primary Examiner*—Paul L. Gensler

*Attorney, Agent, or Firm*—Limbach, Limbach & Sutton

[57] ABSTRACT

A foil covering for the apertured exit window for a broad beam electron gun is placed in tension by stretching it over a raised edge which extends parallel to one of the dimensions of the aperture pattern, thereby creating a hollow space between the foil and the exterior surface of the housing adjacent to the exit window apertures, and then sealing the circumference of the foil to the exterior surface of the housing. When the housing is evacuated, the ambient air pressure presses the foil into this hollow space and thereby stretches the foil taut over the exit window aperture to remove any potential creases or folds in the foil.

11 Claims, 5 Drawing Figures

ANODE FOIL HOLDER FOR BROAD BEAM ELECTRON GUN

BACKGROUND OF THE INVENTION

This invention relates generally to an improved particle accelerator and in particular to an improved high intensity electron gun or accelerator having a large area beam cross-section. More specifically, the invention relates to an improved method and apparatus for tensioning the foil covering for the exit window apertures for such an accelerator.

In U.S. Pat. No. 3,863,163, which patent is incorporated herein by reference, there is described in electron gun of the type having cathode and grid assemblies, a vacuum-tight housing for the cathode and grid assemblies, and a multi-apertured anode support plate which forms one wall of the vacuum-tight housing. An electron transparent foil covers the exterior surface of the anode support plate and is sealed about its circumference to the support plate to perfect the vacuum.

One problem which has arisen in the manufacture of such electron guns is that the foil is typically made of either rolled titanium or aluminum and during the rolling process, the thickness of the foil is not made entirely uniform so that tensions and stresses are produced in the foil causing it to be nonplanar. When the foil is placed over the exit window apertures during fabrication of the electron gun assembly and is sealed to the support plate, there exist no means for drawing it uniformly taut over the apertures because of this nonplanar condition of the foil. When the vacuum is drawn within the housing, the foil is, of course, pulled against the exit window apertures and the support plate. However, because the foil was nonplanar prior to the application of the vacuum, tiny folds or creases are produced in the foil which, due to metal fatigue and other like mechanisms, cause leaks to be produced in the foil, thereby destroying or greatly reducing the vacuum tightness of the housing.

SUMMARY OF THE INVENTION

The above described problem of tensioning a foil placed over the exit window of a particle accelerator is overcome by the present invention of an improvement which comprises means for pulling a portion of the foil away from the exterior wall of the housing, against the force of the ambient air pressure whereby the foil is placed in tension due to the force of the ambient air pressure. In the preferred embodiment of the invention, the foil pulling means include a raised edge on the exterior wall of the housing, which edge extends parallel to a portion of a hypothetical circumference of the pattern of the apertures in the exit window of the housing. The foil is draped over this edge and a clamping flange is used to attach the foil at its circumference to the exterior surface of the housing and for pulling the foil taut against the edge. By draping the foil over the edge, a hollow space is created between the exterior surface of the housing and the foil and when the housing is evacuated, the ambient air pressure forces the foil into this hollow space, thereby putting the foil in tension.

This edge may be defined in a number of ways such as by increasing the thickness of the housing wall adjacent to the seal with the foil, by increasing the thickness of the housing wall adjacent to the apertures, or by locating a ridge on the support plate between the apertures and the foil seal.

It is therefore an object of the present invention to provide a particle accelerator having an evacuated housing with a leak free foil covering for the multi-apertured exit window.

It is another object of the invention to provide a mechanism for placing the foil covering for the apertured exit window of a particle accelerator in tension to reduce creases and folds in the foil when the housing is evacuated.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
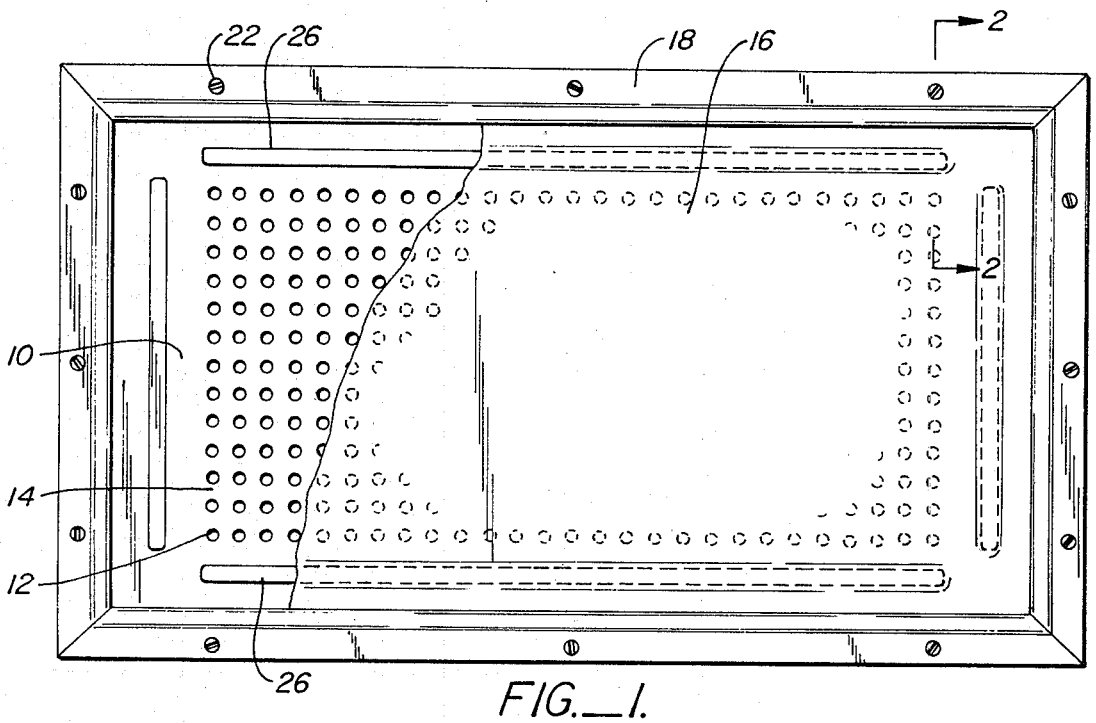
FIG. 1 is a plan view, with portions broken away and in section, of the apertured exit window of a particle accelerator according to the invention.
Figure 2:
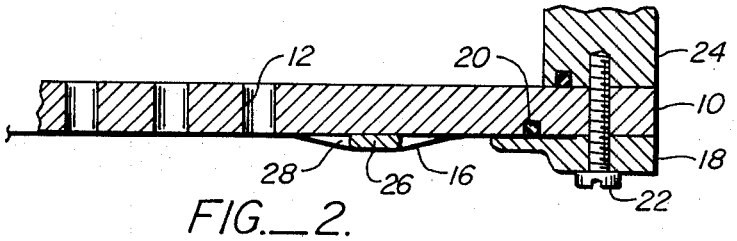
FIG. 2 is an enlarged, vertical, sectional view, with portions broken away, taken generally along the lines 2—2 in FIG. 1.

Referring now more particularly to FIGS. 1 and 2, the anode support plate 10 of a broad beam electron gun of the type described in U.S. Pat. No. 3,863,163 has a plurality of apertures 12 which together form a pattern having a hypothetical circumference 14. The anode support plate 10 forms one wall of a vacuum-tight housing 24 which extends into the plane of FIG. 1. Electrons exit through the apertures 12 out of the plane of FIG. 1 during operation of the electron gun.

In order to operate the gun, it is necessary that the housing be evacuated. To maintain the vacuum, a sheet of foil 16 covers the apertures 12 and is held in a vacuum-tight sealed relation to the anode support plate 10 by means of a foil clamp 18. The foil clamp 18 extends around the circumference of the foil 16 and clamps the foil against the anode support plate 10; pressing the foil 16 against an O-ring seal 20 carried in a groove in the anode support plate 10. The foil clamp 18 is held in place by means of a bolt 22 threaded into the electron gun housing 24.

Thus far the description of the electron gun does not differ from that depicted in U.S. Pat. No. 3,863,163. In order to tension the foil 16 to prevent creasing when the vacuum is drawn within the housing 24, a pair or pairs of ridges 26 are provided on the anode support plate face to pull the foil 16 away from the anode support plate 12 and create a hollow space 28 between the foil 16 and the anode support plate 10. This hollow space 28 is in communication with the apertures 12 so that when a vacuum is drawn inside the housing 24 the hollow space is also evacuated.

It will be noted that the ridges 26 extend parallel to portions of the hypothetical circumference 14 of the exit window aperture pattern. It is necessary during the installation of the foil clamp 18 to pull the foil 16 reasonably taut over the ridges 26, however, it is the evacuation of the housing 24 and the resultant ambient air pressure acting on the foil 16, forcing it into the hollow space 28, which places the foil 16 in tension and prevents creases from forming. This tension is uniform over the portion of the foil which covers the apertures 12.

While in the embodiments depicted in FIGS. 1 and 2, ridges 26 were used to pull the foil 16 away from the surface of the anode support plate 10, any properly shaped and located edge can serve this function. There are various ways in which such an edge can be defined.

Figure 3:
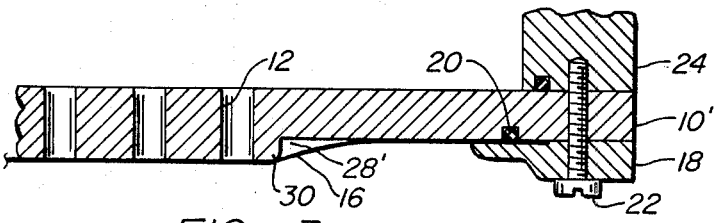
FIGS. 3, 4 and 5 are enlarged, vertical, sectional views, corresponding to the view in FIG. 2 but of alternative embodiments of the invention.

Referring now more particularly to FIG. 3, in this embodiment the thickness of the anode support plate 10' is increased over that portion which includes the apertures 12. This increase in the thickness in the support plate 10' produces a projecting edge 30 which creates a hollow space 28' beneath the foil 16. Again, when the space within the housing 24 is evacuated, the ambient air pressure will force the foil 16 into the hollow space 28' and thereby place the foil 16 in tension to remove all creases and wrinkles.

Figure 4:
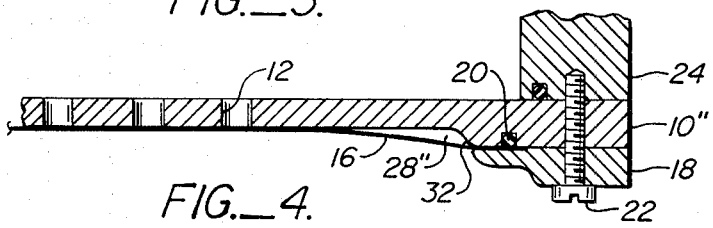

Referring to FIG. 4, the thickness of the anode support plate 10'' is increased adjacent to the seal 20 and the clamping flange 18 to produce a rounded edge 32 which pulls the foil 16 away from the anode support plate 10'' and creates a hollow space 28''.

Figure 5:
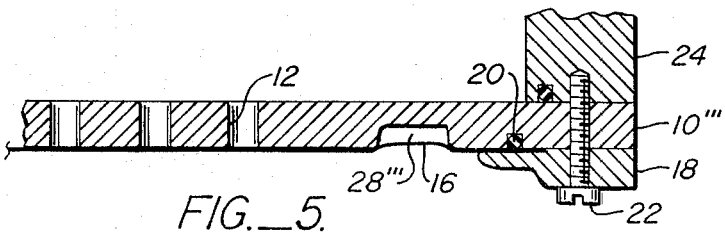

Referring to FIG. 5, the anode support plate 10''' is grooved to create a hollow space 28'''. The foil is pressed into this space when it is evacuated, to stretch the foil taut.

In the preferred embodiment, the foil is titanium or aluminum foil, or made of alloys thereof, which is rolled to approximately 0.01–0.06 mm (0.05–2.5 mils) thick. This foil is transparent to the particles which are admitted through the apertures 12, that is, to the electrons.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention claimed.

What is claimed is:

1. An improved foil support for a particle accelerator of the type having an evacuated housing with a multi-apertured window in one wall thereof through which particles are projected and a particle transparent foil covering the window apertures from outside of the housing and which is sealed to the one wall of the housing against the ambient air pressure, wherein the improvement comprises means for pulling a portion of the foil away from the one wall of the housing against the force of the ambient air pressure whereby the foil is placed in tension.

2. An improved foil support for a particle accelerator as recited in claim 1 wherein the apertures are arranged in a pattern having a hypothetical circumference and the foil pulling means include a raised edge on the one wall of the housing, which edge extends parallel to a portion of the hypothetical circumference with the foil being draped over the edge, and a clamping flange for attaching the foil at its circumference to the one wall and for pulling the foil taut against the edge.

3. An improved foil support for a particle accelerator as recited in claim 1 wherein the particle accelerator is a broad beam, high intensity electron gun and the one wall of the housing is an anode support plate.

4. An improved anode structure for a broad beam electron gun of the type having a vacuum-tight housing and an anode support plate which forms one wall of the vacuum-tight housing and which has an exterior surface, the anode support plate further having a plurality of apertures which extend through it to the exterior surface, an electron transparent foil covering for the anode support plate apertures which is mounted exterior of the housing and in contact with the exterior surface, and means for sealing the foil about its circumference to the support plate, wherein the improvement comprises a projecting, elongated edge on the exterior surface and located beneath the foil covering and between the sealing means and the apertures of the anode support plate, to hold away a portion of the foil covering from the exterior surface of the anode support plate and thereby define a hollow space between the foil portion and the exterior surface, this hollow space being in communication with the anode support plate apertures, whereby when a vacuum is drawn within the housing ambient air pressure will push against the portion of the foil over the hollow space and place the foil in tension.

5. An improved anode structure as recited in claim 4 wherein the projecting edge is defined by an increase in the thickness of the anode support plate adjacent to the sealing means.

6. An improved anode structure as recited in claim 4 wherein the projecting edge is defined by an increase in the thickness of the anode support plate adjacent to the apertures.

7. An improved anode structure as recited in claim 4 wherein the projecting edge is defined by a ridge located on the support plate between the apertures and the sealing means.

8. An improved anode structure as recited in claim 4 wherein the foil is a rolled metal foil.

9. An improved anode structure as recited in claim 8 wherein the foil is 0.01–0.06 mm thick and is selected from the group consisting essentially of titanium, aluminum or alloys thereof.

10. An improved anode structure as recited in claim 4 wherein the anode support plate apertures are arranged in a pattern having a hypothetical circumference and wherein the projecting edge extends parallel to at least a portion of the circumference.

11. A method of tensioning a foil covering for the exterior surface of an apertured exit window of a vacuum-tight housing for a particle accelerator comprising the steps of providing a raised edge on the exterior surface parallel to one dimension of the exit window, stretching the foil taut against the exterior surface and over the exit window and the raised edge to define a hollow space between the foil and the exterior surface of the housing, sealing the foil at its circumference to the exterior surface, and evacuating the housing to cause the ambient air pressure to press against the foil over the hollow space and thereby tension the foil.

* * * * *